United States Patent [19]

Vazquez et al.

[11] Patent Number: 4,491,284

[45] Date of Patent: Jan. 1, 1985

[54] PROCESS AND APPARATUS FOR WINDING AN ELECTRICALLY CONDUCTIVE WIRE INTO AN INDUCTIVE COIL

[75] Inventors: Miguel Vazquez; René Bildé, both of Metz, France

[73] Assignee: France Transfo (S.A.), Maiziers le Metz, France

[21] Appl. No.: 446,030

[22] Filed: Dec. 1, 1982

[30] Foreign Application Priority Data

Dec. 1, 1981 [FR] France ..... 81 22614

[51] Int. Cl.[3] ..... B21C 47/12

[52] U.S. Cl. ..... 242/83

[58] Field of Search ..... 242/82, 83

[56] References Cited

U.S. PATENT DOCUMENTS

| | | | |
|---|---|---|---|
| 2,857,116 | 10/1958 | Krafft et al. | 242/83 |
| 2,929,577 | 3/1960 | Henning . | |
| 3,295,785 | 3/1967 | Felicite . | |
| 3,337,154 | 8/1967 | Smith et al. | 242/83 |

FOREIGN PATENT DOCUMENTS

| | | | |
|---|---|---|---|
| 2352679 | 4/1975 | Fed. Rep. of Germany | 242/83 |
| 549327 | 7/1923 | France . | |
| 1575213 | 7/1969 | France . | |
| 1584089 | 12/1969 | France . | |
| 838424 | 6/1960 | United Kingdom | 242/83 |
| 173282 | 10/1965 | U.S.S.R. . | |

*Primary Examiner*—Stuart S. Levy
*Assistant Examiner*—Leo J. Peters
*Attorney, Agent, or Firm*—Karl F. Ross

[57] ABSTRACT

An insulated wire is wound into a cylindrical coil by being continuously introduced into an annular space between a cylindrical core and a cylindrical sleeve coaxially surrounding same above a supporting surface which is rotated about their axis at an angular velocity W, the wire being fed in at a linear speed V. A processor is programmed to vary the ratio V/W according to the relationship $$(V/W)_i = \pi[D+2d)(a_i-1)]$$

where D is the diameter of the core, d is the wire diameter and $a_i$ is an integer representing the order number of the $i^{th}$ turn of a spiral path, counted from the core surface, along which the wire is laid in a succession of flat layers piled one atop the other. Each layer consists of n contiguous turns following one another in a radially outward direction in odd-numbered layers and in a radially inward direction in even-numbered layers, with decrementation or incrementation of the ratio V/W at the end of each turn. The discharge end of a feed tube is raised above the supporting surface, upon the completion of each layer, by an incremental distance equal to the wire diameter d to accommodate the next layer.

14 Claims, 5 Drawing Figures

PROCESS AND APPARATUS FOR WINDING AN ELECTRICALLY CONDUCTIVE WIRE INTO AN INDUCTIVE COIL

FIELD OF THE INVENTION

Our present invention relates to a process and an apparatus for winding an electrically conductive but insulated wire into a cylindrical coil to form an inductor, e.g. for use in a transformer.

BACKGROUND OF THE INVENTION

Such coils, when used as the inductive windings of transformers operating at a medium or high voltage, must withstand considerable voltage differences between adjacent turns. According to the conventional mode of manufacture, the coil is wound in a succession of cylindrical layers each usually consisting of a number of turns considerably exceeding the number of coaxial layers. The term "wire", as here used, may comprise a single conductor (generally of copper) or, possibly, several conductors twisted together or parallel to one another which are wound jointly to form the coil.

With this mode of winding, superimposed turns at the ends of adjacent layers will be electrically separated by considerable lengths of wire so that significant voltage differences may exist therebetween. This frequently necessitates the interposition of sheets of paper or other dielectric material between the layers in order to avoid breakdowns. Even if the usual wire insulation of enamel or the like suffices for normal operation, such breakdowns could occur in the event of overvoltages due, for example, to lightning discharges. To test the breakdown resistance of the insulation, it is common practice to subject the coil to a "shock wave" in the form of a high-voltage pulse with a steep wavefront which will be considerably higher than the nominal operating voltage of the coil or the transformer. Such a pulse gives rise to an exponential distribution of the voltage along the winding, with a steep voltage gradient at the extremities close to its terminals. This distribution is due primarily to the capacitances existing between adjacent turns within the coil body.

OBJECTS OF THE INVENTION

An object of our present invention is to provide a process for building a cylindrical wire coil of the general type referred to in which the voltage differences between adjacent turns are minimized so as to reduce the effect of parallel capacitances upon the voltage distribution along its conductor or conductors and to insure a substantially uniform linear damping of the applied voltage.

A related object of our invention is to provide an efficient apparatus for implementing this process.

SUMMARY OF THE INVENTION

In accordance with the process aspects of our invention, a wire is deposited on a support in a generally spiral path with contiguous turns by way of a feeder rotating relatively to that support about an axis, the turns following one another in a first radial direction (e.g. outward) to form a first annular layer with predetermined inner and outer diameters. The same wire is then deposited in another generally spiral path with contiguous turns on the first layer while relative rotation between the feeder and the support continues in the same sense as before, the turns now following one another in a second radial direction (inward) opposite the first one to form a second annular layer coextensive with the first layer. The first step is then repeated to form a third layer in essentially the same manner as the first layer, and so on until a coil of predetermined height is completed.

Since each annular layer or "pancake" contains a relatively small number of turns, compared with the number of such layers, only minor voltage differences will exist between superimposed turns of adjacent layers. We have found, in fact, that in many instances no additional insulation will be required between the layers even though the operation could be halted after the completion of a layer to allow the insertion of a dielectric disk. Such inserts, if desired, could be channeled to allow for the circulation of a cooling fluid, especially in the case of large transformers.

According to a more particular feature of our invention, the wire is payed out through the feeder at a linear speed V so related to the angular velocity W of the relative rotation of the feeder and the support, in order to cause or at least assist in the orderly succession of the turns within each layer, that the ratio V/W is varied in a manner proportional to the radius of the turns. This variation may be carried out intermittently, i.e. after each relative revolution, according to the equation $$(V/W)_i = \pi[D + 2d(a_i - 1)] \quad (1)$$

where D is the inner diameter of the layer, d is the wire diameter and $a_i$ represents the order number of the $i^{th}$ turn counted from the inner diameter. Dimensions D and d are measured in the same units of length, e.g. meters, with linear speed V measured in the same units of length per unit time, e.g. meters per second, and angular velocity W measured in revolutions per unit time.

In principle, the orderly succession of the turns could also be brought about or at least assisted by a radial displacement of the feeder with reference to the axis of rotation, and the two procedures could of course be employed jointly.

Pursuant to another aspect of our invention, an apparatus for carrying out the process comprises a first member forming a supporting surface from which a core rises to define the inner diameter D of a cylindrical coil to be formed therearound, this core being centered on an axis perpendicular to the supporting surface and being coaxially surrounded by a cylindrical sleeve defining therewith an annular space also centered on that axis. A tubular guide terminates within that annular space in a discharge end disposed above the supporting surface, this guide being carried on a second member. One of the two members, preferably the first one, is coupled with drive means for being unidirectionally rotated about the axis at the aforementioned angular velocity W. A wire is continuously advanced through the guide at the aforementioned linear speed V, by feed means aligned with its entrance end, into the annular space for deposition on the supporting surface in a generally spiral path with contiguous turns to form a succession of mutually coextensive annular layers as described above. The drive means and the feed means are coupled with control means for establishing a ratio V/W which varies with the turn radius and preferably in a discontinuous manner pursuant to the foregoing equation. This can be accomplished under the control of a processor programmed to change the speed of a first motor, forming part of the drive means, or a second motor, forming part of the feed means, after every relative revolution.

Another advantageous feature of our invention resides in a progressive incrementation of the separation of the feeder from the support, i.e. of the distance of the discharge end of the tubular guide from the bottom of the annular space defined by the core and the sleeve, to an extent sufficient to accommodate an additional layer upon the completion of a preceding layer. For this purpose the two relatively rotatable members are also relatively displaceable along the axis of rotation. This can be accomplished by means including a third motor which is also controlled by the processor and preferably is operatively coupled with the second member carrying the feed means and the guide tube. If no inserts are to be interposed between successive layers, this third motor will be stepped by the processor after the completion of each layer to elevate the discharge end of the guide tube over the supporting surface by an incremental distance equal to the wire diameter d.

Especially when the guide tube is to be progressively lifted above the supporting surface in the manner just described, its discharge end is advantageously designed as a tip of a length of tubing lying close to that surface and is arcuately curved around the axis, preferably about midway between core and sleeve with a downwardly slanting tip.

BRIEF DESCRIPTION OF THE DRAWING

The above and other features of our invention will now be described in detail with reference to the accompanying drawing in which.

SPECIFIC DESCRIPTION

Figure 1:
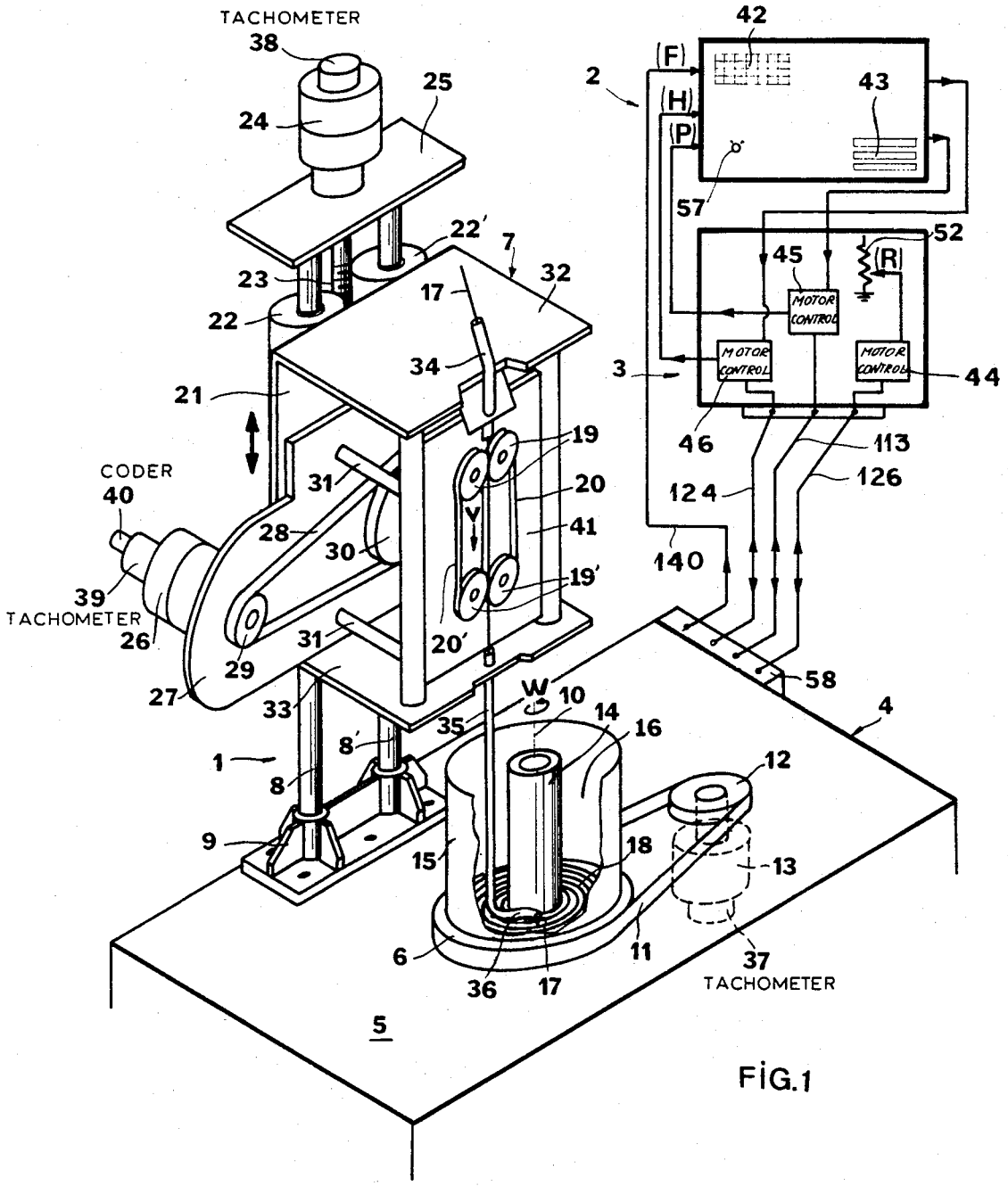
FIG. 1 is a partly diagrammatic perspective overall view of an apparatus embodying our invention, with parts broken away.

The apparatus of FIG. 1 comprises a winding machine 1 piloted by a programmable processor 2 through a control unit 3.

Each of the above-mentioned components will now be described.

The winding machine comprises a frame 4 whose upper flat part forms a work table 5. This latter comprises a horizontal plate member 6 and supports a member 7 movable in vertical translation along two guide columns 8, 8' fixed in a double bracket 9.

Plate 6 is a turntable rotated about its vertical axis 10 by a belt 11 driven by a pinion 12 and forming a reduction unit actuated by a variable-speed motor 13 concealed in frame 4.

A hollow cylindrical core 14, serving as a winding support, rises vertically from plate 6 while being centered on the axis of rotation 10. This core 14 is spacedly surrounded by a coaxial sleeve 15 defining therebetween an annular space 16 designed to receive a coil to be wound. This space is closed at its base by the surface of plate 6 and its upper end is left open to enable the introduction of an insulated electric wire 17 to be coiled.

The mobile member 7 forms a unit having means for feeding this electric wire 17 into the winding space 16 from a conventional spool not shown.

Unit 7 is shaped as a laterally open prismatic box whose front wall 41 carries two identical pairs of upper and lower pulleys 19, 19' continuously advancing the wire 17, with the aid of two conveyor belts 20, 20', in a downward direction at a linear speed V as indicated by an arrow. The vertical rear wall 21 of the box is fitted with two upright sleeves 22, 22', respectively sliding along columns 8, 8', and a nonillustrated nut meshing with a vertical leadscrew 23. This screw is driven by a motor 24 for the vertical adjustment of the mobile member 7 which is mounted on a platform 25 fixed to the top of columns 8, 8'.

Pulleys 19, 19' are rotated by a variable-speed motor 26 cantilevered on the rear face of a support flange 27 projecting from between the front wall 41 and the rear wall 21. To this end, the front face of flange 27 carries a step-down transmission including a belt 28 connecting a small drive pulley 29 with a driven pulley 30; through a set of gears not shown, pulley 30 counterrotates the upper pulleys 19 which, in their turn, drive the lower pulleys 19' through the belts 20 and 20'.

Flange 27 is spacedly secured to the front wall 41 by means of braces 31. Front wall 41 is held between two horizontal plates, namely an upper plate 32 and a lower plate 33, formed as bent-over extensions of rear wall 21. Plates 32, 33 respectively carry at their front edges two substantially vertical tubes 34, 35 for guiding the insulated conducting wire 17.

The guide tube 34 of the upper plate 32 receives the wire from its supply reel and delivers it, at its bottom outlet, to the nip of the upper pulleys 19 between the descending inner runs of the transport belts 20, 20'.

The guide tube 35 is aligned with the nip of the lower pulleys 19' from which it receives the wire 17 at its entrance end to feed it into the annular space 16 where the wire exits with an arcuate curvature, centered on axis 10, from a discharge end 36 in the direction of rotation of plate 6; that direction is assumed to be counterclockwise as indicated by an arrow symbolizing the angular velocity W of the plate. The length of tubing constituting extremity 36 is generally S-shaped, as viewed from the side, within a cylindrical surface radially bisecting the space 16, its tip being curved downward with a moderate slope so that the exiting wire slants toward plate 6.

Figure 2:
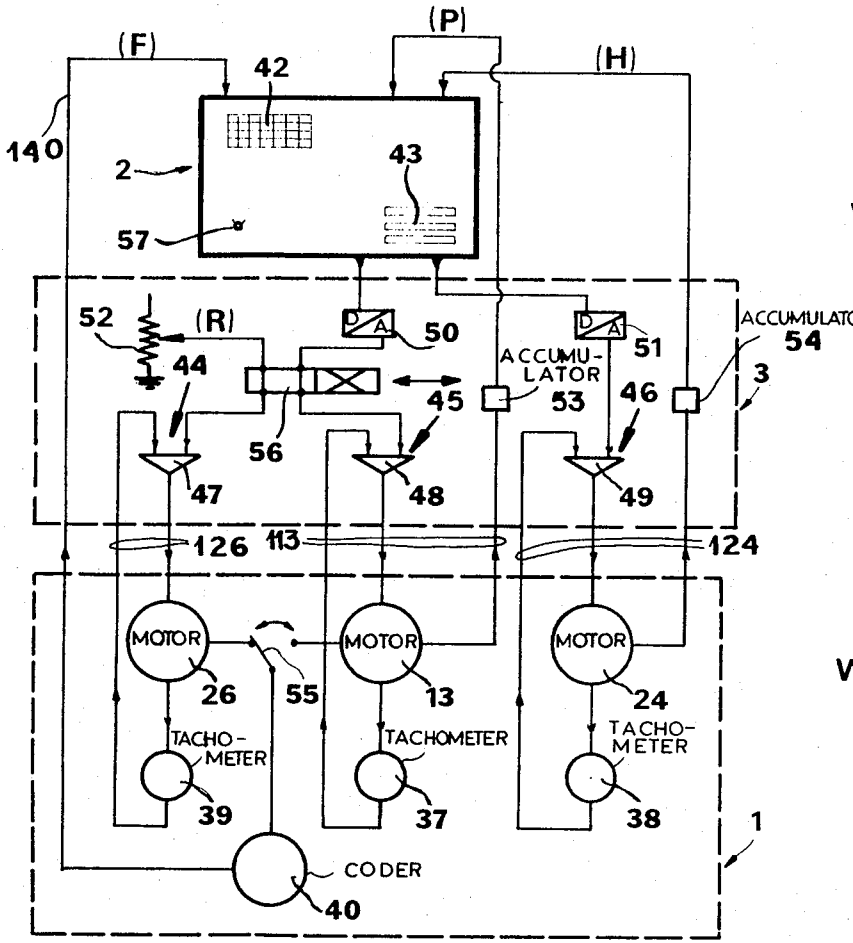
FIG. 2 is a block diagram of a control unit, including a digital processor, forming part of the apparatus of FIG. 1.

This assembly further comprises three tachometers 37, 38 and 39, respectively coupled with motors 13, 24 and 26, and a digital speed coder 40 shown mounted on the free end of the shaft of wire-feed motor 26. Optionally, however, coder 40 could be transferred to the shaft of turntable motor 13 as symbolically indicated by a switch 55 in FIG. 2.

Finally, a terminal box 58 mounted on the side of frame 4 connects motors 13, 24, 26 and their tachometers as well as coder 40 via respective lines 113, 124, 126, 140 to the control unit 3 and the programmable processor 2. The latter is shown provided with a keyboard 42, for feeding in the operating parameters of the winding machine, and with three screens 43 for displaying the operating characteristics. This processor has been programmed to control the operation of the winding machine in accordance with our invention as will be described hereafter.

Unit 3 comprises three sections 44, 45 and 46 which represent the actuators respectively controlling the operation of motors 26, 13 and 24. As can be seen in detail in FIG. 2, these actuators include feedback loops comprising respective comparators 47, 48, 49 whose outputs are connected to the corresponding motors and which each have one input connected to the associated tachometer, the other input receiving a reference signal. In the illustrated position the respective reference signals for the motors 13 and 24 are emitted by the processor 2 via respective digital/analog converters 50, 51 whereas for the wire-feed motor 26 the reference signal (R) is supplied by a manual speed selector 52, i.e. a potentiometer with a slider establishing a constant operating speed for that motor.

Processor 2 receives at its data inputs, on the one hand, a signal (F) on lead 140 representative of the speed of the wire-feed motor 26 supplied by the coder 40 and, on the other hand, two signals (P) and (H) representative, at all times, of the total number of revolutions carried out by motor 13 driving plate 6 and by motor 24 adjusting the elevation of the unit 7, these two signals being supplied by way of respective accumulators 53 and 54. Thus, the magnitudes of these signals (P) and (H) respectively reflect the number of turns of wire 17 laid in space 16 and the number of steps taken by motor 24 to elevate the discharge end 36 of the guide tube 35 above plate 6 after the formation of an annular layer or pancake encompassing a given number n of such turns, six in the present instance. The third signal (F) is delivered by the coder 40 as data for calculating the instantaneous wire speed.

We shall now describe the operation of the illustrated embodiment of our invention.

The preliminary operation consists in centering the core 14 on the rotary plate 6 and anchoring the wire 17 by its free end to the base of this core by any appropriate means, e.g. with the aid of a simple slit provided in that core. Then the sleeve 15 is placed around the core 14, as shown in FIG. 1, to confine the working space 16 in which the winding is to be formed. Thereafter the mobile unit 7 is laterally shifted so as to place the guide tube 35 halfway between core 14 and sleeve 15, whereupon unit 7 is placed in its lowermost position so that the bent end 36 of guide tube 35 opens in the vicinity of the anchorage point of wire 17.

This operation, although not indispensable, is advantageous in that it ensures a better control of the laying of the turns by limiting the free travel of wire 17 at the outlet of tube 35. Wire 17 is then stretched by a slight pull upstream of the intake tube 34 and the winding machine is now ready to operate.

To form a winding in accordance with the process of our invention, the operator supplies the processor 2 with the operating parameters by means of the keyboard 42 placed at the front thereof. These parameters are the diameter d of wire 17, the outer diameter D of core 14, the inner diameter $\phi$ of sleeve 15, the diameter of the pulleys 19, 19', the total number $G_{max}$ of pancakes to be formed and the speed V for feeding the wire 17 into the working space 16.

With these data, the program stored in the processor 2 calculates, on the one hand, the number n of turns per pancake (i.e. $n=\phi-D/2d$) and, on the other hand, the rotational speed to be communicated to motor 26 driving the pulleys 19, 19', that motor speed being a function of transport speed V determined by the kinematic characteristics of transmission 28, 29, 30 which may be translated into wired logic within the processor.

The results obtained are stored in the working memory of the processor and the program then elaborates the instantaneous angular velocity $W_i$ to be imparted to plate 6, thus also the speed at which the wire 17 is wound in space 16. Velocity $W_i$, by which the processor controls in real time the winding procedure, is given by the expression $$W_i = V/\pi[D+2d(a_i-1)] \quad (2)$$

derived from equation (1), supra.

It will be recalled that $a_i$ is a variable integer indicating the order number or rank of the $i^{th}$ turn in the pancake being formed in space 16 as counted from the outer surface of core 14, the increment i progressing from 1 to n in one pancake and from n to 1 in the next one.

The values assumed by the discrete variable $a_i$ are continuously obtained from the remainder r of the division of the magnitude of the signal (P), representing the number of completed pancakes, into the magnitude of the signal (H), representing the total number of turns. Thus, $a_i$ equals r if (H) is odd and equals its complement n−r if (H) is even.

It will be understood that these relationships result from the fact that, with the end of wire 17 anchored to the core 14, the first pancake which is formed is a spiral evolving radially outward, the second one then being a spiral with radially inward evolution, and so on. The conditions would of course be reversed if the wire were anchored on sleeve 15.

To start the winding operation proper, it is sufficient to set a reference signal (R) through the manual potentiometer 52 determining the advancing speed V of wire 17.

During the whole start-up phase, a ramp function is generated in response to that reference signal so that the system gradually reaches steady-state conditions.

It should be noted that, during this entire initial transitory phase, the wire speed V is a variable which the processor 2 calculates from reading the signal (F) emitted by the coder 40 coupled with motor 26.

Under steady-state operating conditions, of course, signals (R) and (F) are substantially equal within the limits of the accuracy of the measuring instruments and the stability of the winding mechanism. The wire 17, introduced into space 16 through the guide tube 35 at a constant speed V imparted to it by the belts 20, 20', is laid in this space in the form of contiguous turns 18 about core 14 as the plate 6 rotates at an alternately decreasing and increasing angular velocity W.

It should be noted that the formation of the turns is also assisted by the median position of guide tube 35, with respect to the width of space 16, and by its bent end 36; this curvature allows the wire to be injected along an arcuate path with a radius equal to that of a median turn. The wire is, of course, flexible enough to adapt its curvature to that called for by the instantaneous ratio V/W. The dependency of this ratio on the variable $a_i$, in accordance with equation (1), provides control of the diameter of the turn being formed and thus causes a spiral outward coiling of the wire into a first pancake; when the number n of turns is reached, a second pancake spiraling inward is laid on the preceding one and so on until the desired number of pancakes have been produced. In general, that number is so chosen as a function of the wire diameter d as to fill the annular space 16 to about four-fifths of its volume.

Whenever a pancake has been coiled, the processor 2 instructs the control section 46 to step the motor 24 to raise the vertically movable unit 7 by an incremental distance about equal to the diameter d of the wire. Advantageously, a limit switch (not shown) may be placed at an appropriate location on the guide columns 8, 8' to stop the entire operation when the desired coil height within space 16 is reached.

Figure 3:
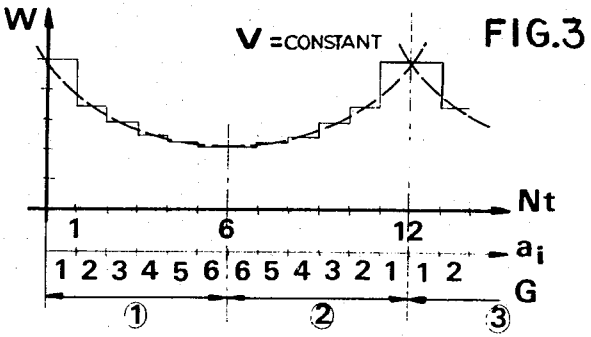
FIG. 3 is a graph showing changes in angular velocity W with constant wire-feeding speed V in one mode of operation of the apparatus of FIG. 1.

It should be noted that one of the important features of the disclosed embodiment of our invention resides in the fact that wire 17 is not pulled by the rotating core 14 but is pushed by the feed unit 7 at a rate so correlated with the winding action as to result, at the level of the turn being formed, in a radial force whose outward or inward direction and intensity depend on the progress of the winding operation; this force imparts to the current turn the diameter corresponding to its position, i.e. to the rank which is assigned thereto within the flat pancake being formed. There occurs, accordingly, a periodic change in the angular velocity W whose cycle, as shown in FIG. 3, corresponds to the duration of the formation of two consecutive pancakes, namely to 2n revolutions of plate 6. In this graph, which applies to a constant linear speed V, we have marked along the abscissa the total number Nt of turns in the coil, the rank $a_i$ of each turn in its pancake and the number G of these pancakes.

As can be seen, the mean course of the stepped curve representing the variable W over a 12-turn period conforms to two symmetrical hyperbolic sections merging into each other. The first section with decreasing slope corresponds to the radially outward coiling of an initial pancake while the second section with increasing slope represents the radially inward coiling of the next pancake. The steps of the curve are of staggered height representing the discrete variations of the rotational speed of the plate occurring when passing from one turn to the next in the same pancake. Accurate control of the winding speed is assured by the digitally operating processor 2.

Comparative tests have been carried out on a coil formed in accordance with our invention from a round copper wire having a diameter of 1.12 mm wound in 175 pancakes at a rate of 20 turns per pancake, corresponding to a "class-24" transformer. These tests showed a very high resistance of the coil to voltage shocks simulating lightning discharges in the absence of any insulation other than the original sheathing of the copper wire with the usual enamel coating.

More particularly, whereas the contractually specified resistance to shocks for transformers of the abovementioned class are of the order of 125 kV, the test winding according to our invention was found to withstand voltage pulses beyond 200 kV without any trouble.

As will be readily apparent, the turns of the coil can be wound not only by rotation of the winding support 6—with the feed point of wire 17 fixed in space—but also, and in an equivalent manner, by holding the plate 6 motionless and by causing the wire to rotate thereabout. This may be achieved, for example, by designing the wire-feed unit 7 as a rotatable turret centered on axis 10 above the plate.

Similarly, the correlation of speed ratio V/W with the evolution of the pancake being formed may be achieved not only by modulating the angular velocity W, with the linear speed V held constant as in FIG. 3, but also by maintaining the winding speed at a selected value while varying the speed of feeding the wire.

In this case, the kinematic relationship of these two speeds established by processor 2 is given by $$V_i=\pi[D+2d(a_i-1)]\cdot W \qquad (3)$$

which is another transformation of equation (1).

Figure 4:
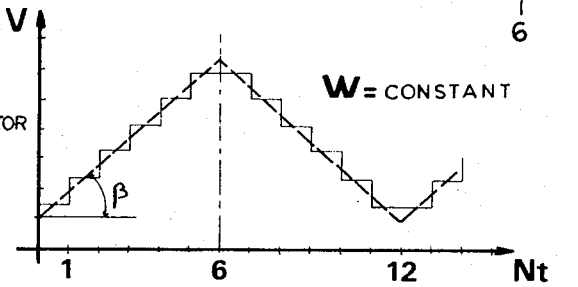
FIG. 4 is a graph similar to that of FIG. 3 but showing changes in speed V with constant angular velocity W in another mode of operation of the apparatus.

In FIG. 4 we have shown a stepped curve representative of the variations of the wire-feed speed V with the angular velocity W kept constant. This curve, in the period of formation of two pancakes, has a mean in the form of two straight line segments symmetrically converging at their top point on passing from the first pancake to the second one with a slope given by ±tan B. The steps of each line segment are of the same height corresponding to the speed increment of $2\pi dW$ to be added to or subtracted from the wire-feed speed V on passing from one turn to the next in the same pancake. A changeover between the modes of FIGS. 3 and 4 is possible, in a manner symbolized in FIG. 3 by the two-position selector 55 already referred to, by coupling the coder 40 to one or the other of the motors 26 and 13 with concurrent operation of a reversing switch 56 to transpose the connections extending from potentiometer 52 and D/A converter 50 to comparators 47 and 48. A master switch 57 on processor 2 facilitates these mode-switching operations. Selector 55 may be constituted by clutches controlled by that master switch to couple the coder 40 to either of the two motor shafts via suitable transmissions; the coder, of course, may be disposed for this purpose at a location different from that illustrated in FIG. 1.

The progressive elevation of the feed unit 7, while not indispensable, has the advantage of delivering the wire into the working space 16 in the vicinity of the coiling plane, thus minimizing the delay between the incipient formation of a turn and the planar positioning thereof within the pancake being formed on the surface of plate 6 or on the previously completed layer. This avoids the risk of kinking of the wire on its discharge from tube end 36. The upward stepping of unit 7 is to take into account a possible "swelling" of the turns in the finished coil. Also, if inserts for the circulation of a cooling fluid are to be interposed between the layers, the incremental rises will have to be large enough to accommodate these inserts.

Figure 5:
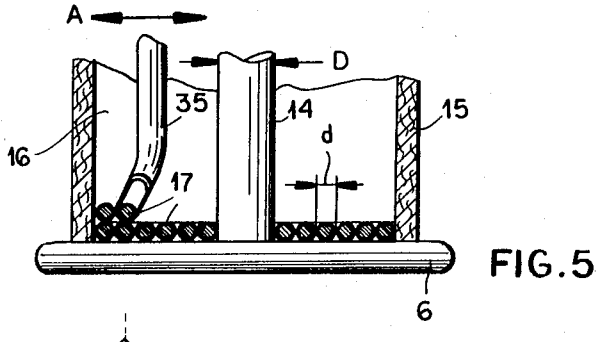
FIG. 5 is a detail view illustrating part of a coil being formed by the apparatus.

The aforedescribed configuration of tubing 36, imparting a preliminary curvature to the issuing wire, could be modified to make the tip of that tubing substantially tangential to an imaginary cylinder centered on axis 10 within space 16, again preferably halfway between the core 14 and its surrounding sleeve 15. In any event, means could be provided on unit 7 to reciprocate that tip radially at the rate of one wire diameter d per revolution so as to position the outlet end of tube 35 always directly above the turn being formed. This has been indicated by an arrow A in FIG. 5 which shows the first layer and part of the second layer of a coil being formed in space 16. The sleeve 15 bounding that space could be made of cardboard and may be permanently retained on the coil to serve also for insulating same from the contents of a vessel in which it will be used.

Our invention, moreover, allows a complete transformer element to be wound directly about a magnetic core without further operations except, possibly, the positioning of the usual clamping disks at the ends of the winding. One of these disks may be initially disposed on the bottom of the working space during the erection of the core on the plate 6.

We have found that, with a guide tube 35 simply bent in a horizontal plane at its outlet end, the turns being formed tend to rise up at high rotational speeds of the supporting plate 6. It is for this reason that we prefer to give to the tip of the tube the aforedescribed downward inclination whereby the wire is thrust down toward the bed of turns already laid and comes to lie flat on its supporting surface even at large angular velocities.

The process according to our invention may be implemented with wires from the smallest diameter up to values greater than 10 mm. Especially the heavier wires ought to be made of copper suitably annealed for proper flexibility. By way of example, a copper wire having a diameter of 0.9 mm may be wound with peak rotational plate speeds of about 400 rpm.

Our invention, while primarily intended for high- and medium-voltage transformer windings, is not limited to this field of use but can be utilized in the production of electric windings designed for any inductive apparatus, in particular of the static type, having a large number of turns which by conventional practice would form a number of coaxial cylindrical layers of considerable axial length. The wires could have a variety of cross-sections, e.g. round, square or rectangular. A coil could be wound in the described manner from several interleaved single-strand or mulistrand wires fed via respective guide tubes into working space 16.

We claim:

1. An apparatus for winding an insulated electrically conductive wire into a cylindrical coil, comprising:

a first member forming a horizontal supporting surface;

a cylindrical core rising from said supporting surface with a vertical axis;

a cylindrical sleeve on said supporting surface coaxially surrounding said core and defining therewith an annular space centered on said axis;

a tubular guide extending substantially vertically from above into said annular space and terminating in a discharge end disposed above said supporting surface, said discharge end being curved about said axis and having a downwardly inclined outlet about midway between said core and said sleeve;

a second member supporting said guide, said members being relatively vertically displaceable;

a first motor coupled with one of said members for unidirectionally rotating same about said axis at an angular velocity W;

feed means on said second member aligned with an entrance end of said guide and driven by a second motor for continuously advancing a wire at a linear speed V through said guide into said annular space for deposition on said supporting surface on a generally spiral path with contiguous turns to form a succession of mutually coextensive annular layers between said core and said sleeve;

control means coupled with said first motor and said feed means for establishing a ratio V/W proportional to the radius of said turns, said ratio alternately decreasing and increasing progressively over consecutive series of n revolutions of said one of said members where n is the number of wire turns fitting between said core and said sleeve whereby said turns follow one another in a radially outward direction within every other layer and in a radially inward direction within every intervening layer, said control means including a processor programmed to change the speed of one of said motors after every revolution of said one of said members; and means including a third motor for relatively vertically displacing said members, said third motor being controlled by said processor to take a step after each $n^{th}$ revolution of said one of said members for raising said discharge end above said supporting surface by an incremental distance sufficient to accommodate an additional layer.

2. An apparatus as defined in claim 1 wherein said one of said members is said first member, said third motor being operatively coupled with said second member.

3. An apparatus as defined in claim 1 wherein said processor is programmed to change the speed of said one of said motors after every revolution to an extent satisfying the equation $$(V/W)_i = \pi[D + 2d(a_i - 1)]$$

where D is the outer diameter of said core, d is the wire diameter, $a_i$ represents the order number of the $i^{th}$ turn of a layer counted from said core, D and d are measured in units of length, V is measured in said units of length per unit of time, and W is measured in revolutions per said unit of time.

4. An apparatus as defined in claim 1 wherein said discharge end is a length of tubing lying in a cylindrical surface centered on said axis.

5. An apparatus as defined in claim 4 wherein said outlet is a tip of said length of tubing slanting downwardly toward said supporting surface.

6. A process for winding an insulated electrically conductive wire into a cylindrical coil centered on an axis, comprising the steps of:

(a) providing a space bounded by an inner cylindrical surface and an outer cylindrical surface rising coaxially from a horizontal support;

(b) forcedly advancing said wire through a substantially vertical feeder from above into said space to a discharge point in said space closely overlying said support about midway between said surfaces;

(c) imparting to said wire at said discharge point an initial curvature centered on the axis of said surfaces, with a downward inclination;

(d) relatively rotating said feeder and said support about said axis at an angular velocity W so related to the linear speed of advance V of said wire that the ratio V/W changes progressively in a sense causing said wire to form coplanar spiral turns of progressively varying radius contiguously deposited on said support in a first annular layer, bounded by said surfaces, in which said turns follow one another in a direction from one surface to the other surface;

(e) increasing the spacing of said discharge point from said support by an incremental distance sufficient to accommodate an additional layer;

(f) inverting the sense of progressive change of said ratio V/W to deposit said wire on said first layer in the form of a second annular layer with spiral turns of progressively varying radius following one another in a direction from said other surface to said one surface;

(g) repeating step (e);

(h) forming a third annular layer coextensive with said first and second layers by depositing the wire on said second layer in a succession of spiral turns in the same way as in step (d); and (i) proceeding in like manner, with inversion of the sense of progressive change of said ratio V/W between successive layers deposited one upon the other, until a coil of predetermined height has been produced.

7. A process as defined in claim 6 wherein said ratio is changed upon the completion of each relative revolution of said feeder and said support according to the equation $$(V/W)_i\pi[D+2d(a_i-1)]$$

where D is the inner diameter of a layer, d is the wire diameter, $a_i$ represents the order number of the $i^{th}$ turn counted from said inner diameter, D and d are measured in units of length, V is measured in said units of length per unit of time, and W is measured in revolutions per said unit of time.

8. A process as defined in claim 7 wherein said linear speed is held constant, said angular velocity being progressively decremented after each revolution in the formation of a layer having turns of increasing radius and being progressively incremented after each revolution in the formation of a layer having turns of decreasing radius.

9. A process as defined in claim 7 wherein said angular velocity is held constant, said linear speed being progressively incremented after each revolution in the formation of a layer having turns of increasing radius and being progressively decremented after each revolution in the formation of a layer having turns of decreasing radius.

10. A process for winding an insulated electrically conductive wire into a cylindrical coil centered on an axis, comprising the steps of:

(a) providing a space bounded by an inner cylindrical surface and an outer cylindrical surface rising coaxially from a horizontal support;

(b) forcedly advancing said wire through a substantially vertical feeder from above into said space to a discharge point in said space closely overlying said support;

(c) imparting to said wire at said discharge point an initial curvature centered on the axis of said surfaces, with a downward inclination;

(d) relatively rotating said feeder and said support about said axis at an angular velocity W so related to the linear speed of advance V of said wire that the ratio V/W changes progressively in a sense causing said wire to form coplanar spiral turns of progressively varying radius contiguously deposited on said support in a first annular layer, bounded by said surfaces, in which said turns follow one another in a direction from one surface to the other surface;

(e) increasing the spacing of said discharge point from said support by an incremental distance sufficient to accommodate an additional layer;

(f) inverting the sense of progressive change of said ratio V/W to deposit said wire on said first layer in the form of a second annular layer with spiral turns of progressively varying radius following one another in a direction from said other surface to said one surface;

(g) repeating step (e);

(h) forming a third annular layer coextensive with said first and second layers by depositing the wire on said second layer in a succession of spiral turns in the same way as in step (d); and (i) proceeding in like manner, with inversion of the sense of progressive change of said ratio V/W between successive layers deposited one upon the other, until a coil of predetermined height has been produced, the orderly succession of the turns within each layer being at least assisted by a radial displacement of said feeder with reference to said axis.

11. An apparatus as defined in claim 1 wherein said feed means comprises two vertical, parallel corotating endless conveyor belts bracketing said wire between them above an entrance end of said tubular guide for forcedly moving the wire through said guide.

12. An apparatus for winding an insulated electrically conductive wire into a cylindrical coil, comprising:

a first member forming a horizontal supporting surface;

a cylindrical core rising from said supporting surface with a vertical axis;

a cylindrical sleeve on said supporting surface coaxially surrounding said core and defining therewith an annular space centered on said axis;

a tubular guide extending substantially vertically from above into said annular space and terminating in a discharge end disposed above said supporting surface;

a second member supporting said guide, said members being relatively vertically displaceable;

a first motor coupled with one of said members for unidirectionally rotating same about said axis at an angular velocity W;

feed means on said second member aligned with an entrance end of said guide and driven by a second motor for continuously advancing a wire at a linear speed V through said guide into said annular space for deposition on said supporting surface on a generally spiral path with contiguous turns to form a succession of mutually coextensive annular layers between said core and said sleeve;

control means coupled with said first motor and said feed means for establishing a ratio V/W proportional to the radius of said turns, said ratio alternately decreasing and increasing progressively over consecutive series of n revolutions of said one of said members where n is the number of wire turns fitting between said core and said sleeve whereby said turns follow one another in a radially outward direction within every other layer and in a radially inward direction within every intervening layer, said control means including a processor programmed to change the speed of one of said motors after every revolution of said one of said members to an extent satisfying the equation $$(V/W)_i=\pi[D+2d(a_i-1)]$$

where D is the outer diameter of said core, d is the wire diameter, $a_i$ represents the order number of the $i^{th}$ turn of a layer counted from said core, D and d are measured in units of length, V is measured in said units of length per unit of time, and W is measured in revolutions per said unit of time; and means including a third motor for relatively vertically displacing said members, said third motor being controlled by said processor to take a step after each $n^{th}$ revolution of said one of said members for raising said discharge end above said supporting surface by an incremental distance sufficient to accommodate an additional layer.

13. An apparatus as defined in claim 12 wherein said feed means comprises two vertical, parallel corotating endless conveyor belts bracketing said wire between them above an entrance end of said tubular guide for forcedly moving the wire through said guide.

14. A process for winding an insulated electrically conductive wire into a cylindrical coil centered on an axis, comprising the steps of:

(a) providing a space bounded by an inner cylindrical surface and an outer cylindrical surface rising coaxially from a horizontal support;

(b) forcedly advancing said wire through a substantially vertical feeder from above into said space to a discharge point in said space closely overlying said support;

(c) relatively rotating said feeder and said support about said axis at an angular velocity W so related to the linear speed of advance V of said wire that the ratio V/W changes progressively upon the completion of each relative revolution of said feeder and said support, according to the equation $$(V/W)_i = \pi[D + 2d(a_i - 1)]$$

where D is the inner diameter of a layer, d is the wire diameter, $a_i$ represents the order number of the $i^{th}$ turn counted from said inner diameter, D and d are measured in units of length, V is measured in said units of length per unit of time, and W is measured in revolutions per said unit of time, in a sense causing said wire to form coplanar spiral turns of progressively varying radius contiguously deposited on said support in a first annular layer, bounded by said surfaces, in which said turns follow one another in a direction from one surface to the other surface;

(d) increasing the spacing of said discharge point from said support by an incremental distance sufficient to accommodate an additional layer;

(e) inverting the sense of progressive change of said ratio V/W to deposit said wire on said first layer in the form of a second annular layer with spiral turns of progressively varying radius following one another in a direction from said other surface to said one surface;

(f) repeating step (d);

(g) forming a third annular layer coextensive with said first and second layers by depositing the wire on said second layer in a succession of spiral turns in the same way as in step (c); and (h) proceeding in like manner, with inversion of the sense of progressive change of said ratio V/W between successive layers deposited one upon the other, until a coil of predetermined height has been produced.

* * * * *